US008733720B2

(12) United States Patent
Wilkinson

(10) Patent No.: US 8,733,720 B2
(45) Date of Patent: May 27, 2014

(54) ROTATABLE BANNER SUPPORT ASSEMBLY

(76) Inventor: Wes Wilkinson, Innisfil (CA)

( * ) Notice: Subject to any disclaimer, the term of this patent is extended or adjusted under 35 U.S.C. 154(b) by 186 days.

(21) Appl. No.: 13/272,989

(22) Filed: Oct. 13, 2011

(65) Prior Publication Data

US 2012/0124876 A1 May 24, 2012
US 2012/0317852 A9 Dec. 20, 2012

Related U.S. Application Data

(60) Provisional application No. 61/392,640, filed on Oct. 13, 2010.

(51) Int. Cl.
*G09F 17/00* (2006.01)

(52) U.S. Cl.
CPC ..... *G09F 17/00* (2013.01)
USPC ..... 248/218.4; 248/230.1; 116/174

(58) Field of Classification Search
USPC ..... 248/218.4, 538, 521, 523, 540–541, 248/219.1–219.4, 230.1, 230.3, 229.12, 248/229.22, 228.3, 231.41, 230.5, 125.7, 248/522, 315, 316.1, 539, 74.1; 116/173–174; 40/606.01, 40/606.15–606.16; 135/28, 38–39, 43, 16; 384/424; 403/335–338, 290
See application file for complete search history.

(56) References Cited

U.S. PATENT DOCUMENTS

| | | | | |
|---|---|---|---|---|
| 2,672,118 | A | 3/1954 | Martin | |
| 3,975,068 | A * | 8/1976 | Speckin | 248/230.5 |
| 5,701,840 | A * | 12/1997 | Cross | 116/174 |
| 5,809,930 | A * | 9/1998 | Brooks | 116/174 |
| 5,961,087 | A * | 10/1999 | Lee | 248/362 |
| 6,565,052 | B1 | 5/2003 | Doublet | |
| 6,811,132 | B1 | 11/2004 | Ferdinand et al. | |
| 6,845,730 | B2 * | 1/2005 | Cardarelli | 116/173 |
| 2002/0178997 | A1 * | 12/2002 | Tsui-Hua | 116/174 |
| 2011/0162575 | A1 * | 7/2011 | Jahnz | 116/173 |
| 2011/0240824 | A1 * | 10/2011 | Wade | 248/541 |

* cited by examiner

*Primary Examiner* — Anita M King
*Assistant Examiner* — Ingrid M Weinhold
(74) *Attorney, Agent, or Firm* — Patterson Thuente Pedersen, P.A.

(57) ABSTRACT

A rotatable banner support assembly comprises upper and lower plates spaced by at least one spacing fastener and each defining a passage for circumscribing a support member, a plurality of brackets mounted on one of the upper and lower plates to frictionally engage the support member at least one of the brackets being radially adjustable, and a rotatable annular disc disposed between the upper and lower plates and circumscribing the at least one spacing fastener, the rotatable disc configured to retain a banner arm.

29 Claims, 11 Drawing Sheets

ROTATABLE BANNER SUPPORT ASSEMBLY

CROSS-REFERENCE TO RELATED APPLICATIONS

This application claims the benefit of U.S. Provisional Application No. 61/392,640 to Wilkinson filed on Oct. 13, 2010 and entitled "Rotatable Banner Support Assembly", the entire content of which is incorporated herein by reference.

FIELD OF THE INVENTION

The present invention relates generally to support assemblies and in particular to a rotatable banner support assembly.

BACKGROUND OF THE INVENTION

Banners are used by many organizations to advertise various promotions and events throughout the year. Banners are often supported from light poles, other upright supports or other suitable supporting structures by way of support assemblies that have banner arms. Typically, the banners are supported in such a manner that the banners may be easily seen but are out of reach of the public.

When mounted in outdoor environments, the banners are exposed to elements such as wind, rain and ice. In the case of static support assemblies, if wind blows with enough force, the support assemblies may break off from the supporting structure. If rotatable support assemblies are used, formation of ice on the support assemblies may inhibit the support assemblies from rotating again placing the support assemblies at risk. A number of support devices have been developed to mount banners onto pre-existing supporting structures that can withstand outdoor elements such as wind.

For example, U.S. Pat. No. 4,880,195 to Lepley describes a banner support assembly adapted to be mounted on a supporting member for purposes of engaging and holding taut an elongated banner having sleeve-like openings in the opposite longitudinal ends thereof. The banner support assembly includes first and second housing members each having a body with an elongated T-shaped channel opening outwardly of the body along a front face and at least one end thereof Each T-shaped channel has an abutment member at the other end of the channel. The first and second housing members are adapted to be mounted a prescribed distance apart on the supporting member and with each longitudinal axis of each T-shaped channel being axially aligned and with the openings in the at least one ends thereof facing in the same direction. First and second holder members are provided having a generally T-shaped cross section conformed to the cross-sectional shape of the T-shaped channels and being adapted to be received in a respective one of the T-shaped channels through the openings in the aforesaid at least one ends thereof. An elongated and elastically flexible wand is fixedly secured to each holder member and, when the holder member is mounted on the housing member, is adapted to extend outwardly away from the housing member through the opening in the front face of the housing member. The wands are each adapted to be received in a selected one of the two sleeve-like openings in the banner. The length of the banner is generally equal to a spacing between the wands whereat the wands are joined to the holder members when the holder members both abut the abutment members.

U.S. Pat. No. 6,565,052 to Doublet describes a support system for vertically hanging a flexible banner. The support system includes two horizontally extending arms for supporting the banner tautly. A dampener is connected at an inner end of each respective arm, the dampener including a movable first element on which is fixed a respective horizontally extending arm, a fixed bracket second element for securement to a vertical support surface, and an intermediary elastic member mounted between the first and second elements.

U.S. Pat. No. 6,811,132 to Ferdinand et al. describes a device for mounting a member to a support surface. The device includes a member holder which can rotate at least partially on an axis to a new position when subjected to a predetermined torque.

U.S. Pat. No. 2,672,118 to Martin describes a device for attaching a flag and halyard arrangement to a flag pole. The device has upper and lower attachments positioned around the flag pole. Each attachment has a floating member, the floating member in the upper attachment having an eye through which a halyard is threaded and the floating member in the lower attachment having a cleat at which the ends of the flag halyard are attached. The upper and lower attachments include a casing which is molded from two vertical halves. Each half is formed with a semi-circular race. When the two halves of the casing are secured together around the pole, the two semi-circular races form together an annular race. Each floating member consists of a generally triangular-shaped piece having an eye or a cleat at its apex. At either corner of the base of the triangular-shaped piece is a spindle to which are attached disc bearings for rotation about the spindles. Under action of the wind pulling the floating member radially outwardly, the disc bearings will engage the upper and lower side walls of the annular race.

Although various banner supports have been considered, improvements are desired. It is therefore an object of the present invention to provide a novel rotatable banner support assembly.

SUMMARY OF THE INVENTION

Accordingly, in one aspect there is provided a rotatable banner support assembly comprising upper and lower plates spaced by at least one spacing fastener and each defining a passage for circumscribing a support member; a plurality of brackets mounted on one of the upper and lower plates to frictionally engage the support member, at least one of the brackets being radially adjustable; and a rotatable annular disc disposed between the upper and lower plates and circumscribing the at least one spacing fastener, the rotatable disc being configured to retain a banner arm.

In one embodiment, the upper and lower plates are coaxial. The upper and lower plates may be circular in plan. The rotatable disc may have an outer radius equal to an outer radius of the upper and lower plates and the rotatable disc may have an inner radius greater than an inner radius of the upper and lower plates.

In one embodiment, a plurality of the brackets may be radially adjustable. Each of the brackets may comprise a flange for frictionally engaging the support member. In this case, each flange is axially aligned with the support member when frictionally engaged therewith.

In one embodiment, the upper and lower plates and the rotatable annular disc may each be defined by first and second segments that are assembleable to circumscribe the support member. Each of the first and second segments may comprise mating formations enabling the segments to be assembled in a jigsaw-puzzle-like manner.

According to another aspect there is provided a rotatable banner support assembly comprising upper and lower plates spaced by at least one spacing fastener and each defining a passage for circumscribing a support member; a plurality of brackets mounted on one of the upper and lower plates to frictionally engage the support member; and a rotatable annular disc disposed between the upper and lower plates and circumscribing the at least one spacing fastener, the rotatable disc being configured to retain a banner arm and comprising at least first and second disc segments, said disc segments carrying mating formations for enabling the disc segments to be assembled in a jigsaw-puzzle-like manner.

BRIEF DESCRIPTION OF THE DRAWINGS

Embodiments will now be described more fully with reference to the accompanying drawings in which.

DETAILED DESCRIPTION OF THE EMBODIMENTS

The following is directed to a rotatable banner support assembly that is configured to be installed on a support member such as a light pole or other suitable upright support, and to support a banner therefrom. The rotatable banner support assembly is adjustable to accommodate different shapes and sizes of support members, and to enable safe installation at a low height, where it can be later raised to a desired height for use. In one embodiment, the rotatable banner support assembly is formed of components that are configured to be assembled around the support member and connected to one another in a jigsaw-puzzle-like manner. As will be appreciated, this enables the rotatable banner support assembly to be readily attached to, or removed from, the support member.

Figure 1:
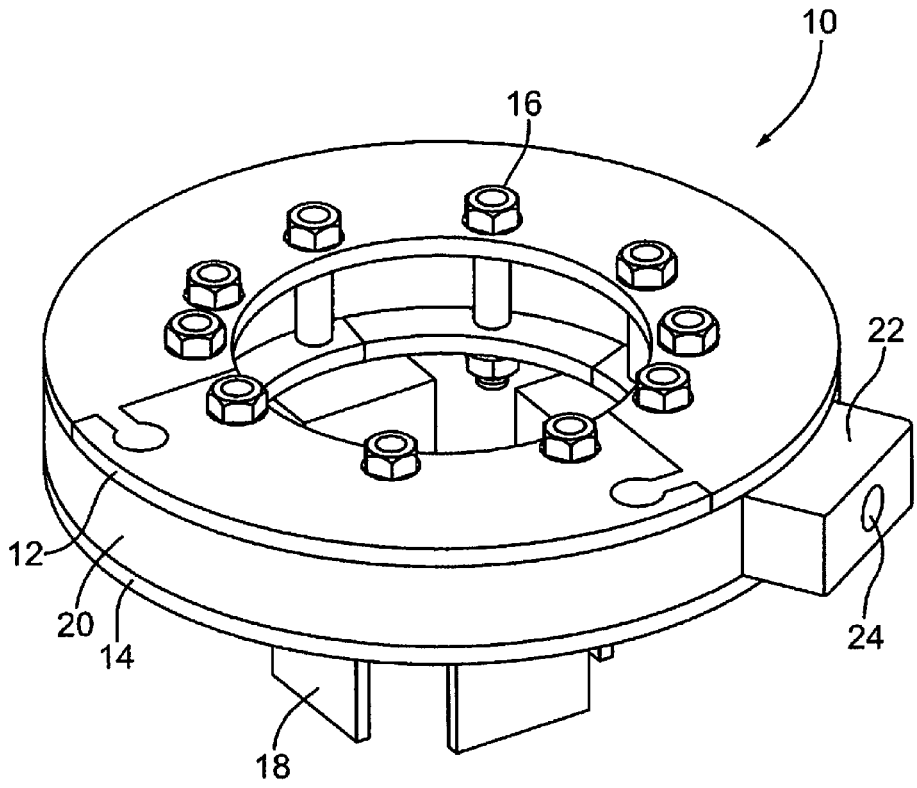
FIG. 1 is a perspective view taken from above of a rotatable banner support assembly.
Figure 2:
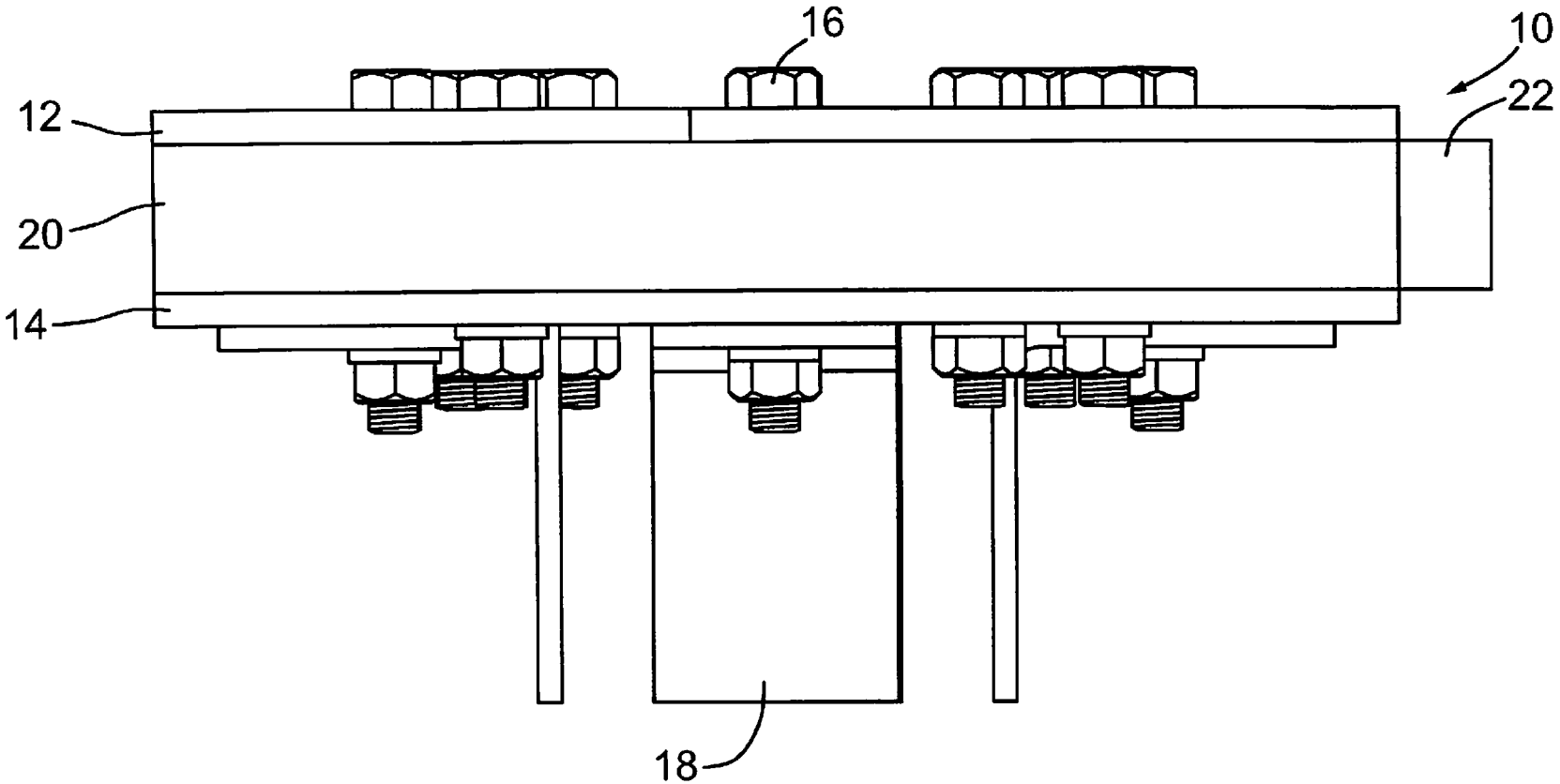
FIG. 2 is an elevational view of the rotatable banner support assembly of FIG. 1.
Figure 3:
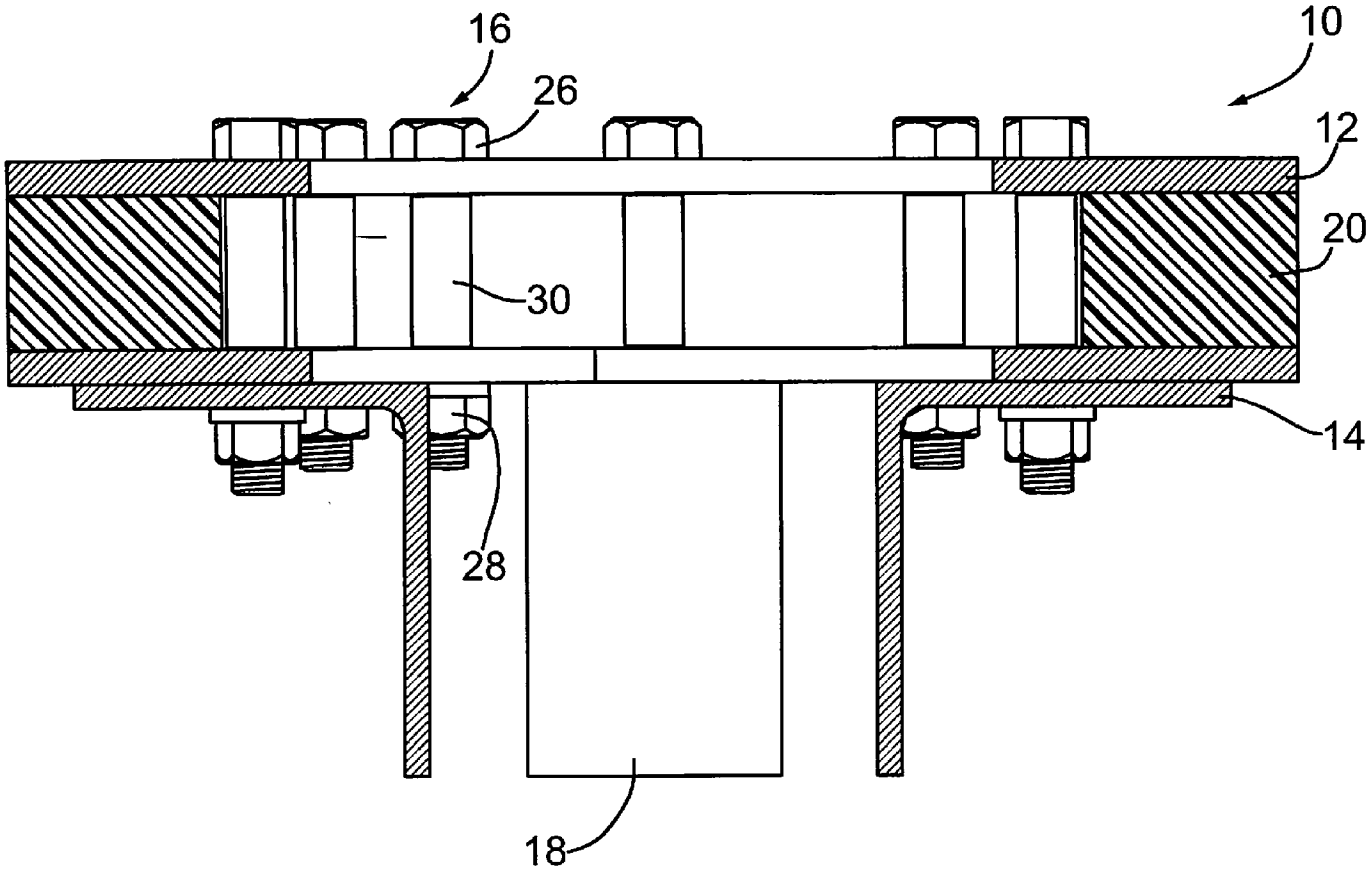
FIG. 3 is a cross-sectional view of the rotatable banner support assembly of FIG. 1.
Figure 4:
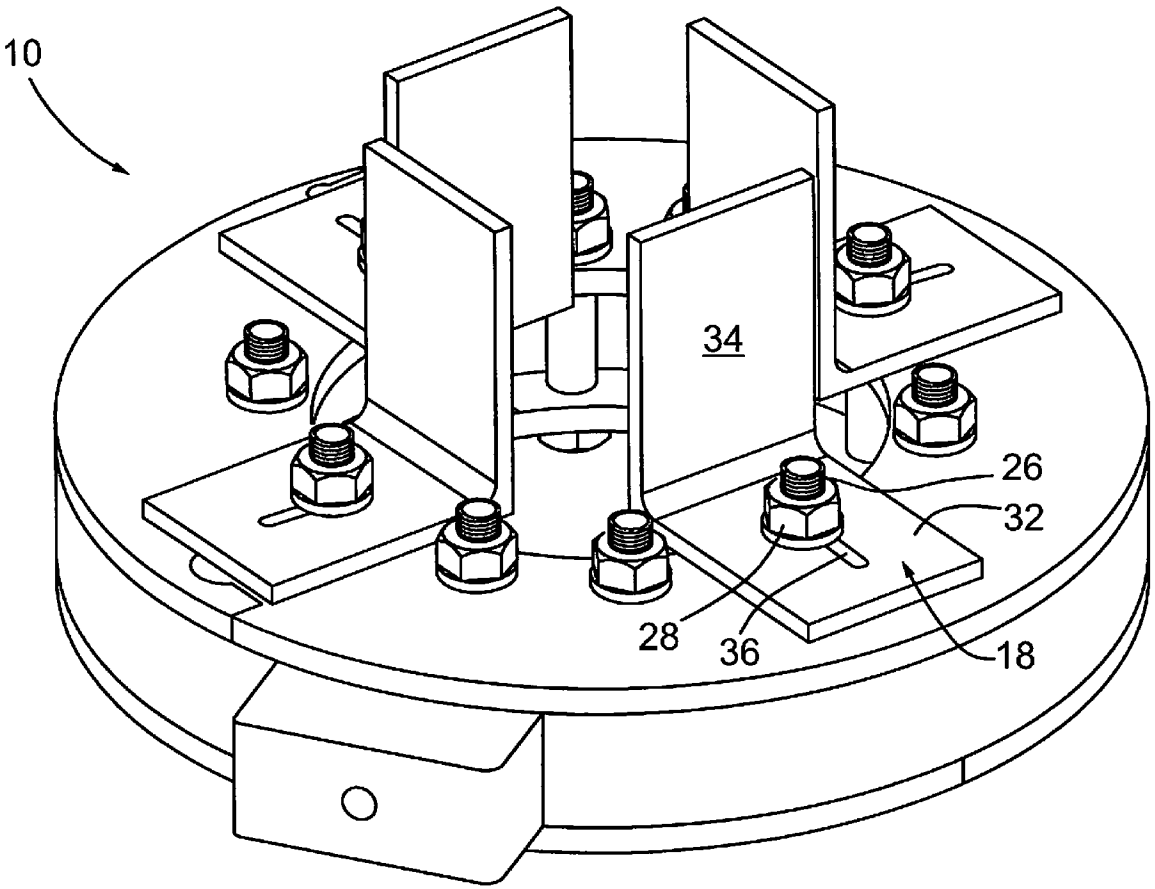
FIG. 4 is a perspective view taken from below of the rotatable banner support assembly of FIG. 1.

Turning now to FIGS. 1 to 3, a rotatable banner support assembly is shown and is generally identified by reference numeral 10. In this embodiment, the rotatable banner support assembly 10 comprises upper and lower plates 12 and 14 which in are annular and generally circular in plan. Upper and lower plates 12 and 14 are vertically spaced by a plurality of circumferentially spaced, spacing fasteners 16 extending between the upper and lower plates 12 and 14. The annular upper and lower plates 12 and 14 each define a passage for circumscribing a support member (not shown) such as a vertical pole having a square or circular cross section. Brackets 18 are mounted on the lower plate 14 at circumferentially spaced locations and are radially adjustable with respect to the lower plate 14 for frictionally engaging the support member (not shown). Disposed between the upper and lower plates 12 and 14 is a rotatable annular disc 20. The rotatable annular disc 20 circumscribes the plurality of spacing fasteners 16. A tab 22 extends radially outward from the annular disc 20 and has a slot 24 formed therein that is dimensioned to receive and retain a banner arm (not shown).

In this embodiment, the upper and lower plates 12 and 14 are made of stainless steel, and all edges on the plates 12 and 14 are bevelled to ensure free rotation of the rotatable annular disc 20. The rotatable annular disc 20 is made of plastic.

Each of the spacing fasteners 16 comprises a bolt 26, a nut 28 and a metal sleeve 30. The metal sleeves 30 extend between the upper and lower plates 12 and 14 and are axially aligned with holes or openings 42 provided in the upper and lower plates (see FIGS. 5*a* and 5*b*) to define bolt passages. Each bolt 26 extends through a respective bolt passage and is sized so that the end of the bolt extends beyond the lower plate 14 when the head of the bolt rests of the upper plate 12. Each nut 28 is secured to its respective bolt 26 below the lower plate 14.

In this embodiment, the brackets 18 are L-shaped members with each bracket comprising an arm 32 extending radially inward from the lower plate 14 and a flange 34 extending vertically at a right angle from the innermost edge of arm 32. Each arm 32 has a longitudinally extending slot 36 formed therein through which one of the bolts 26 passes allowing for radial adjustment of the arm 32 when the nut 28 that engages the bolt is loosened. This enables the banner support assembly to accommodate different sizes and/or shapes of support members.

Figure 5A:
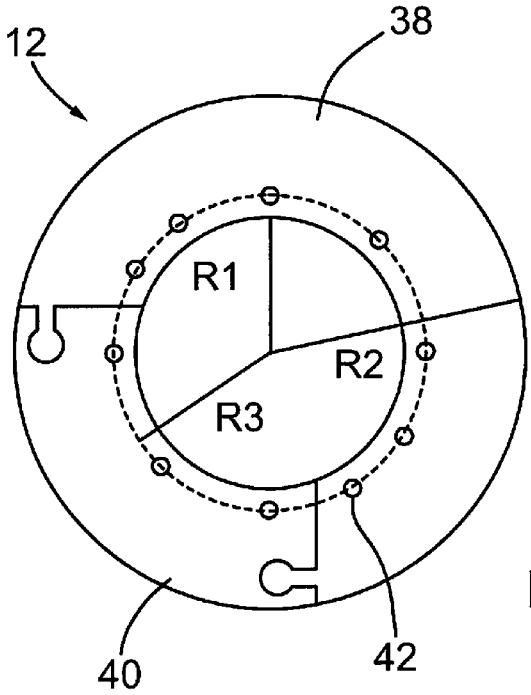
FIGS. 5*a* and 5*b* are top plan views of an upper plate forming part of the rotatable banner support assembly of FIG. 1.
Figure 5B:
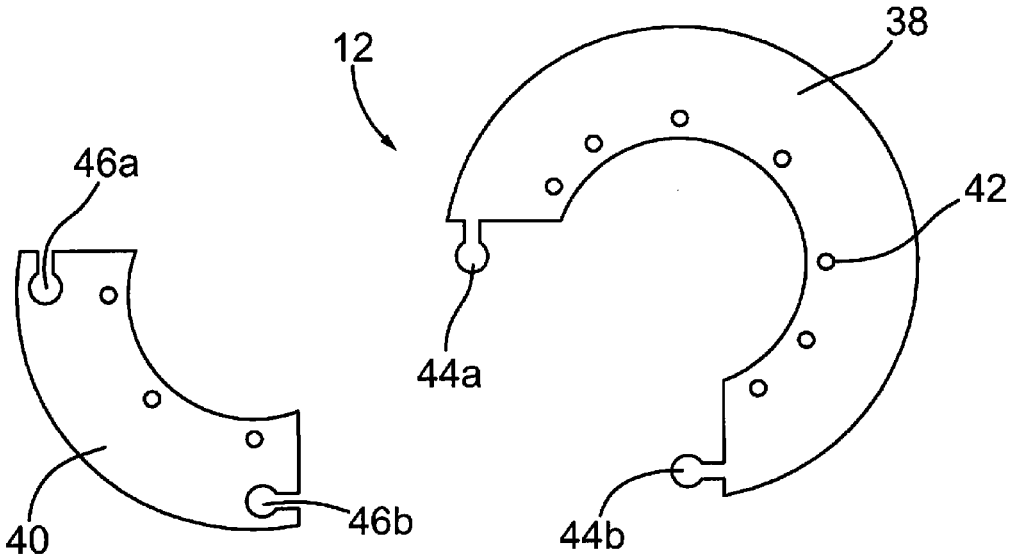

FIG. 5*a* shows the upper plate 12 in top plan. As can be seen, upper plate 12 comprises first and second segments 38 and 40, which, when assembled, form a circular annular disc that has an inner radius R1 and an outer radius R2. In this embodiment, radius R1 is equal to about 2.82 inches and radius R2 is equal to about 5.0 inches. The openings 42 are circumferentially spaced about the upper plate 12 and define a circle having a radius R3 equal to about 3.22 inches. Each of the openings 42 is circular in shape and has a radius equal to about 0.19 inches. Turning to FIG. 5*b*, the first and second segments 38 and 40 are shown in a disassembled state. As can be seen, first segment 38 comprises male formations or connecting members 44*a* and 44*b* extending from opposite ends of the segment 38. Second segment 40 comprises female formations 46*a* and 46*b* formed therein, each adjacent an opposite end of the segment 40. The male connecting members 44*a* and 44*b* are complementary in shape to the female formations 46*a* and 46*b* allowing the first and second segments 38 and 40 to be assembled in a jigsaw-puzzle-like manner by interlocking the male connecting members 44*a* and 44*b* with the female formations 46*a* and 46*b*, respectively. It will be noted that lower plate 14 has a substantially identical configuration. As a result of this configuration, seams are formed between the first and second segments 38 and 40 of the upper and lower plates 12 and 14 when assembled. Two of the brackets 18 are positioned to overlay the seams formed between the first and second segments 38 and 40 of the lower plate 14.

Figure 6A:
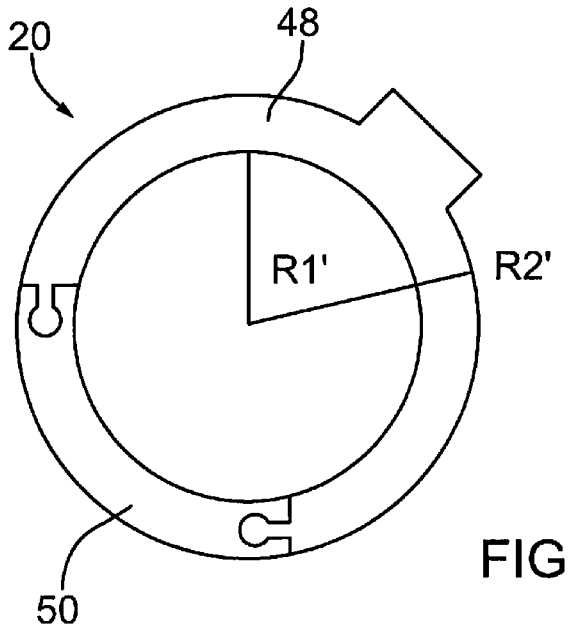
FIGS. 6*a* and 6*b* are top plan views of a rotatable annular disc forming part of the rotatable banner support assembly of FIG. 1.

Turning to FIG. 6*a*, the rotatable annular disc 20 is shown in top plan. Similar to the upper and lower plates 12 and 14, rotatable annular disc 20 comprises first and second disc segments 48 and 50 which, when assembled, form a circular annular disc having an inner radius R1' and an outer radius R2'. In this embodiment, radius R1' is equal to about 3.5 inches, and radius R2' is equal to about 5.0 inches. As will be appreciated, radius R1' is greater than radius R1 and radius R2' is equal to radius R2. Radius R1' is also greater than radius R3 such that the rotatable annular disc 20 circumscribes the plurality of openings 42 when disposed between the upper and lower plates 12 and 14.

Figure 6B:
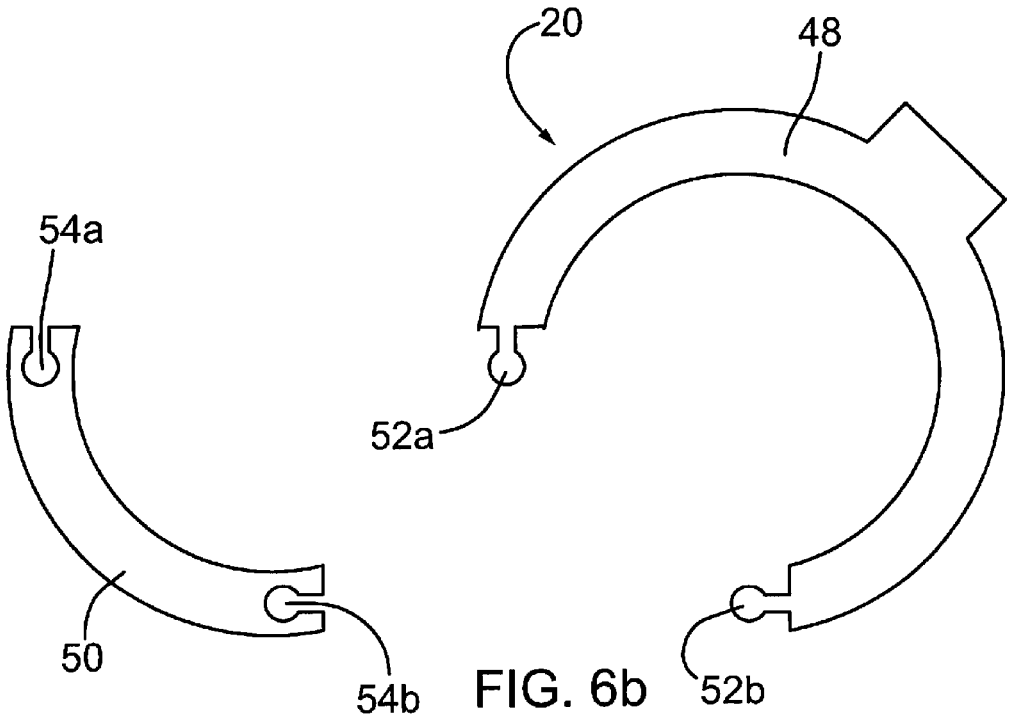

FIG. 6*b* shows the first and second disc segments 48 and 50 of rotatable annular disc 20 in a disassembled state. Similar to the upper and lower plates 12 and 14, first disc segment 48 comprises male formations or connecting members 52*a* and 52*b* extending from opposite ends of the segment 48. Second disc segment 50 comprises female formations 54*a* and 54*b* formed therein each adjacent an opposite end of the segment 50. The male disc connecting members 52*a* and 52*b* are complementary in shape to female formations 54*a* and 54*b*. The first and second disc segments 48 and 50 are assembled in a jigsaw-puzzle-like manner by interlocking the male disc connecting members 52*a* and 52*b* with the female formations members 54*a* and 54*b*, respectively. In addition, the disc segments 48 and 50 are secured to one another using one or more setscrews or other suitable fasteners (not shown).

The difference between the inner radius R1' of the rotatable annular disc 20 and the inner radius R1 of each of the upper and lower plates 12 and 14 defines a spacing annular region on each of the upper and lower plates 12 and 14. The plurality of openings 42, which define a circle having radius R3, are spaced about the spacing annular region on each of the upper and lower plates. In this manner, the rotatable annular disc 20 circumscribes the spacing fasteners 16 which extend between the openings 42 on the upper and lower plates 12 and 14.

Figure 7:
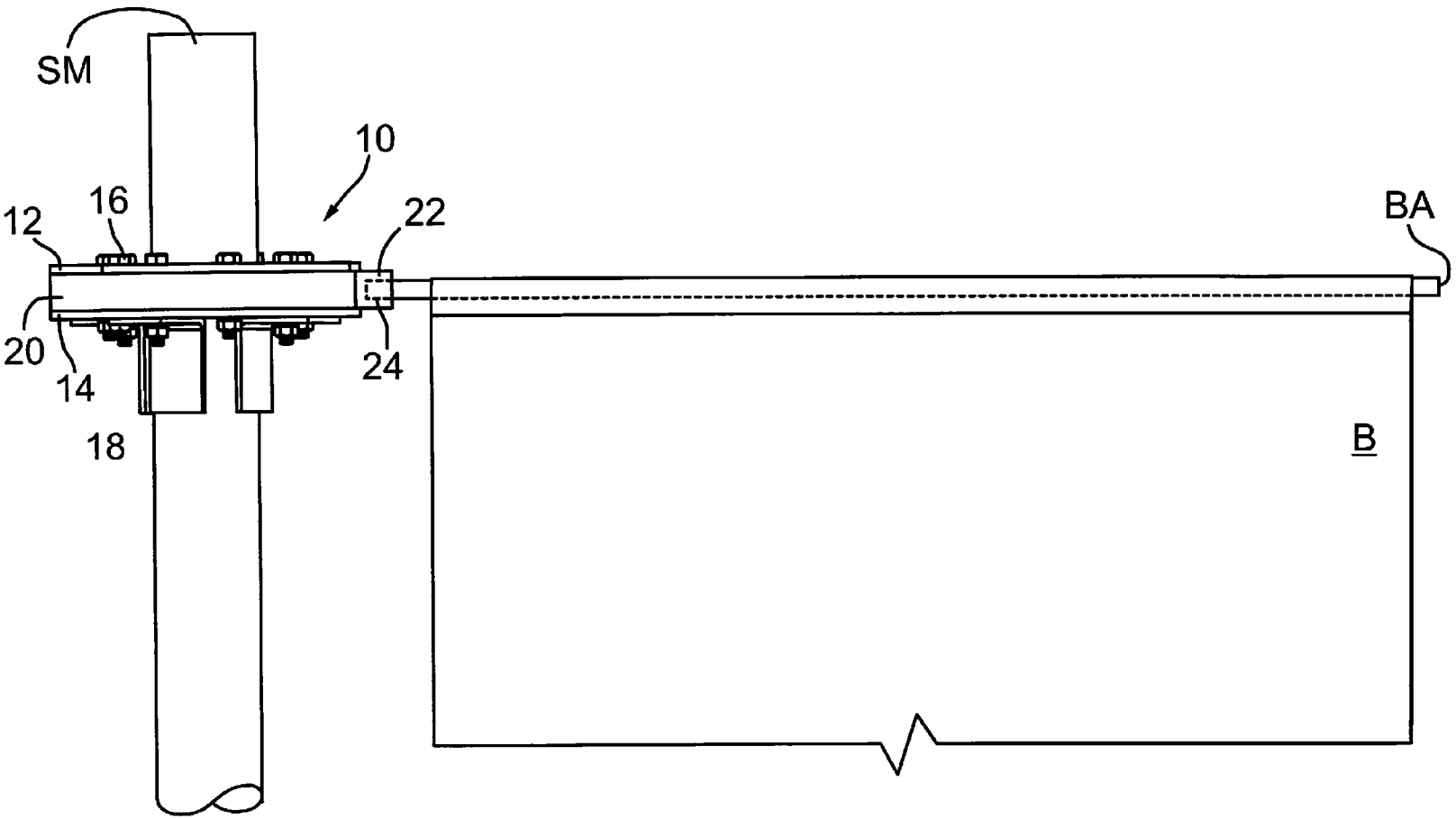
FIG. 7 is an elevational view of the rotatable banner support assembly of FIG. 1 installed on an upright support member in the form of a pole.

Turning now to FIG. 7, a front elevation view of the rotatable banner support assembly 10 installed on a support member SM is shown. As can be seen, the support member SM extends through the passage defined by the upper and lower plates 12 and 14. The brackets 18 are positioned to frictionally engage the support member SM such that the support assembly 10 is securely mounted on the support member SM thereby to inhibit the rotatable banner support assembly 10 from sliding along the support member SM. A banner arm BA is retained with the slot 24 on the tab of the rotatable annular disc 20 and extends radially outward therefrom. Banner arm BA supports a banner B.

With the rotatable banner support assembly 10 installed on the support member SM at the desired elevation, in the event that the wind blows above a threshold force, the rotatable annular disc 20 rotates with respect to the upper and lower plates 12 and 14 in response to the force applied to the banner B by the wind, permitting adjustment of the banner's position and therefore reducing the amount of force the wind has on the banner B. In the event that rotatable banner support assemblies 10 are installed on neighbouring support members SM, each of the rotatable annular discs will rotate to approximately the same position such that all of the banners will all be aligned with one another, creating an aesthetically pleasing display.

The rotatable banner support assembly 10 is installed on the support member SM by first orienting the brackets 18 such that the flanges 34 are brought into contact with the support member SM. The brackets 18 are temporarily secured to the support member SM by wrapping a tool such as a ratchet strap or zip-tie around the brackets 18 and the support member SM. The lower plate 14 is then assembled around the support member SM by interlocking the first segment 38 and the second segment 40 such that the male connecting members 44*a* and 44*b* and female formations 46*a* and 46*b* are in mating engagement. The lower plate 14 is then positioned such that two of the brackets 18 overlay the seams defined between the segments 38 and 40 and such that openings 42 in the lower plates are vertically aligned with the slots 36 of the brackets 18.

The rotatable annular disc 20 is then assembled around the support member SM by interlocking the first disc segment 48 and the second disc segment 50 such that the male connecting members 52*a* and 52*b* and female formations 54*a* and 54*b* are in mating engagement. Setscrews are then inserted into the rotatable annular disc 20 to ensure a tight connection between the first and second disc segments 48 and 50. The rotatable annular disc 20 is positioned above the lower plate 14 such that the inner radius R1' of the rotatable annular disc 20 circumscribes the openings 42 of the lower plate 14.

The upper plate 12 is then assembled around the support member SM by interlocking the first segment 38 to the second segment 40 such that the male connecting members 44*a* and 44*b* and female formations 46*a* and 46*b* are in mating engagement. The upper plate 12 is positioned above the rotatable annular disc 20 such that the openings 42 are vertically aligned with the openings of the lower plate 14. The seams between the segments 38 and 40 are positioned so that they are offset or misaligned with the seams between the segments 38 and 40 defining the lower plate 14.

The sleeves 30 of the spacing fasteners 16 are then positioned intermediate between the upper and lower plates 12 and 14 and in alignment with the openings. Each bolt 26 is then inserted through a respective opening 42 of the upper plate 12, sleeve 30, and opening 42 of the lower plate 14. Nuts 28 are then tightened around the ends of the bolts 26. The banner arm BA holding the banner B is inserted into slot 24, and secured using a setscrew. The temporary securement of the brackets 18 to the support member SM is then removed. The nuts 28 connected to the bolts 26 extending through slots 36 can thereafter be loosened and the brackets 28 moved radially outward to allow the vertical height of the rotatable banner support assembly 10 to be adjusted to a desired height. Once at the desired height, the brackets 28 can be moved radially inward to abut the support member SM and the nuts 28 re-tightened. In this manner, the rotatable banner support assembly 10 can be safely installed on a support member SM at a low height and then raised to a desired height for use. The radial adjustment of the brackets 18 allows for the rotatable banner support assembly 10 to be installed on a variety of support members SM such as vertical poles having square or rectangular cross sections.

Figure 8:
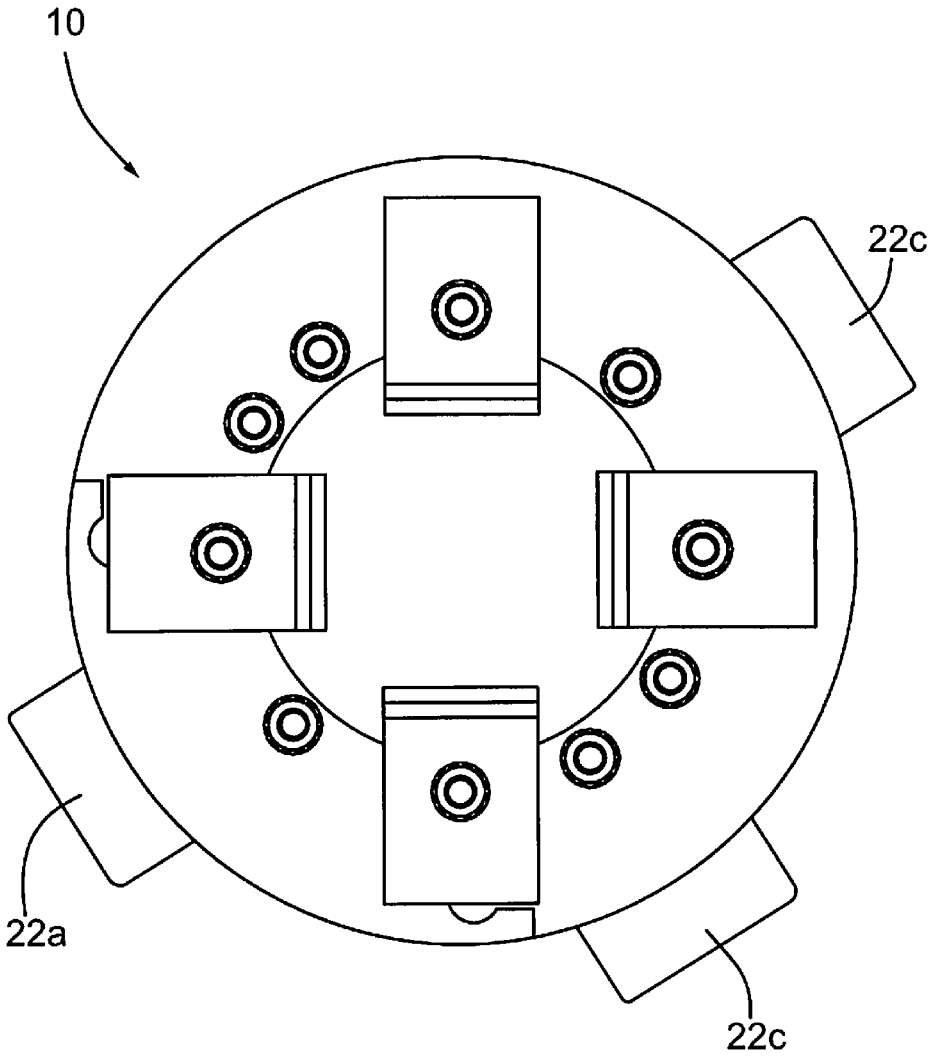
FIG. 8 is a bottom plan view of an alternative rotatable support assembly according to a further embodiment.

Although the rotatable banner support assembly 10 is described as having a single tab 22 extending radially outward from the rotatable annular disc 20, those skilled in the art will appreciate that any number of tabs may be used. For example, as shown in FIG. 8, the rotatable annular disc 20 may have three tabs 22*a*, 22*b* and 22*c* spaced apart from one another and extending radially outward. In this embodiment, the rotatable banner support assembly 10 can support three (3) banners B.

Figure 9:
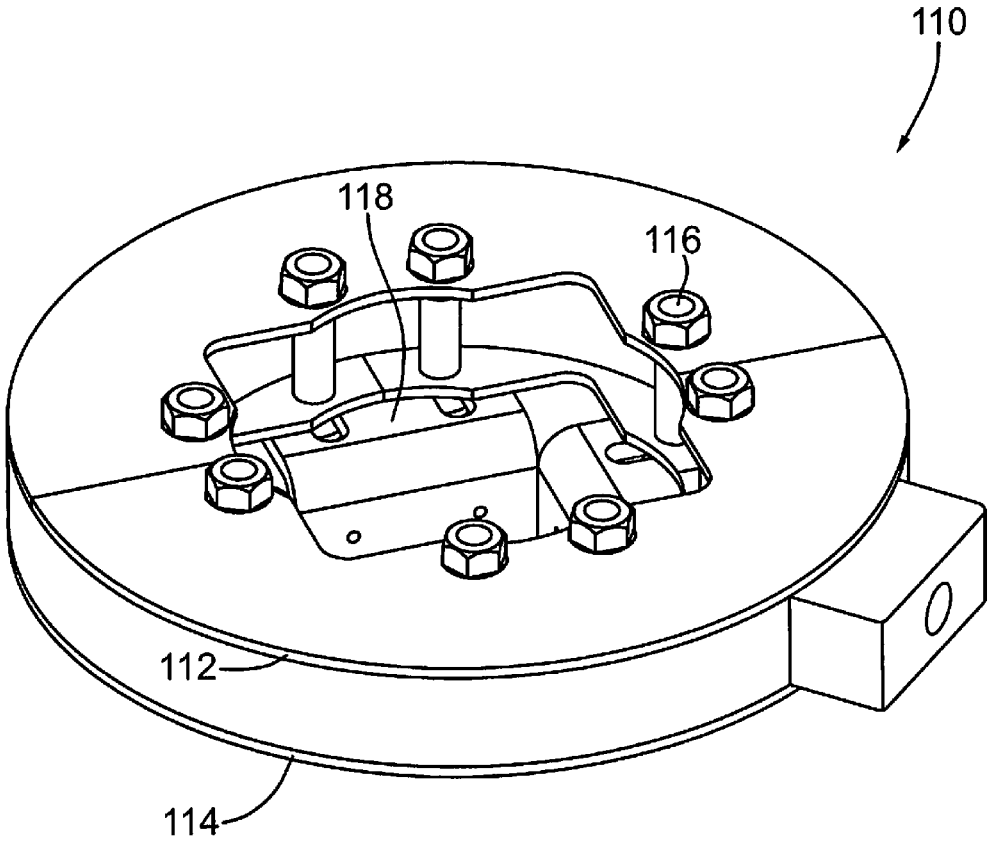
FIG. 9 is a perspective view taken from above of another embodiment of the rotatable banner support assembly.
Figure 10:
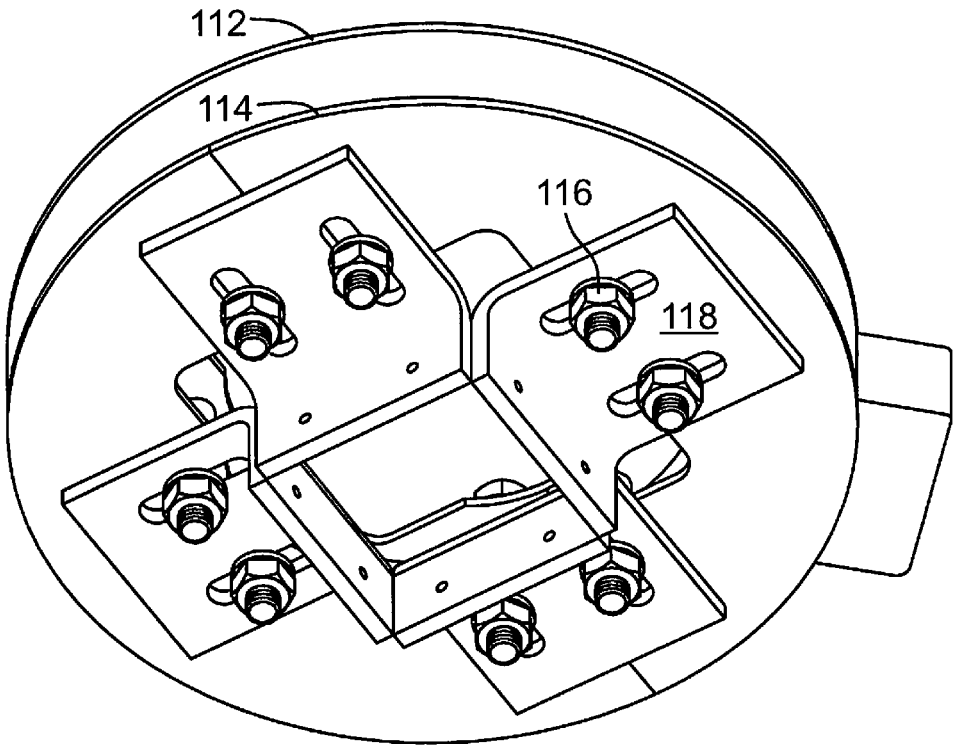
FIG. 10 is a perspective view taken from below of the rotatable banner support assembly of FIG. 9.
Figure 11:
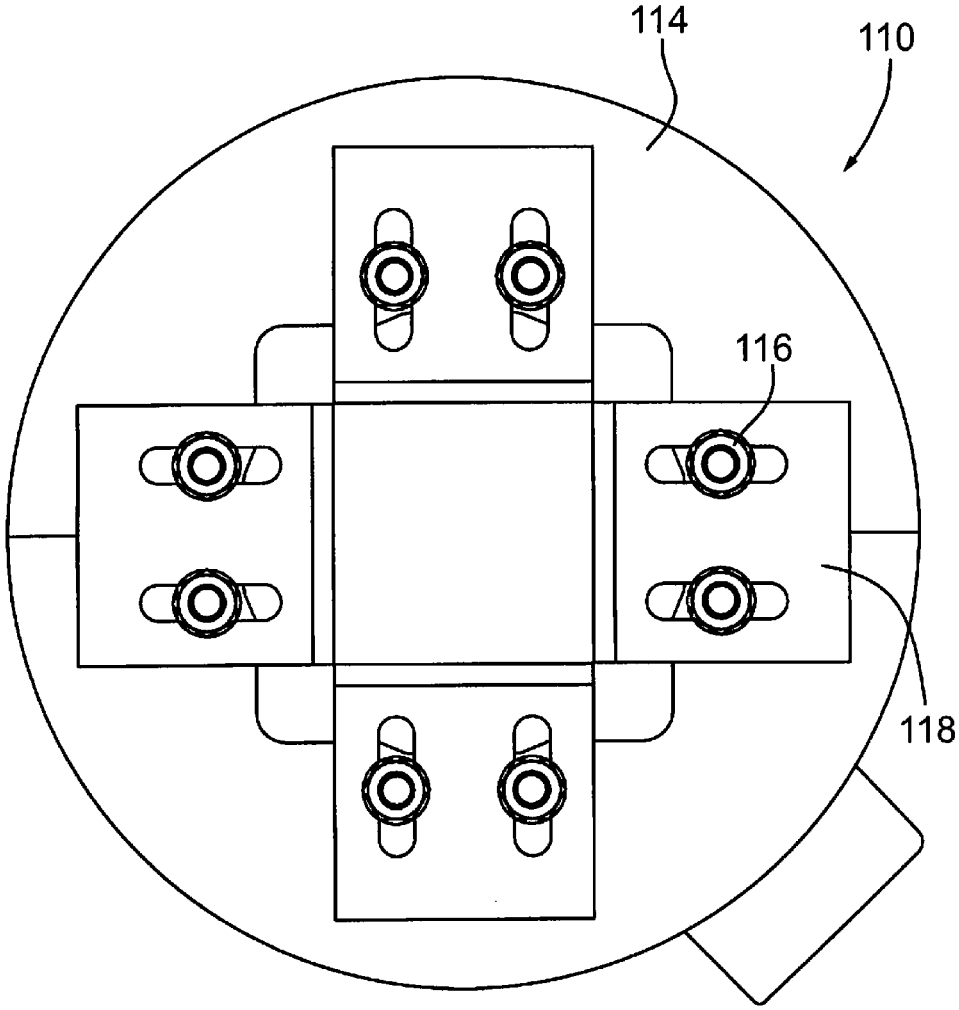
FIG. 11 is a bottom plan view of the rotatable banner support assembly of FIG. 9.

Turning now to FIGS. 9 to 11, another embodiment of a rotatable banner support assembly is shown and is generally identified by reference numeral 110. In this embodiment, like reference numerals will be used to indicate like components with a "100" added for clarity. As can be seen, banner support assembly 110 is similar to banner assembly 10, with the exception of the following.

In this embodiment, the brackets 118 have a greater width than brackets 18, such that edges of the brackets 118 are in contact or in near contact with edges of neighbour brackets 118. Thus, the configuration of the four (4) brackets 118 creates a square-shape for mounting on a vertical pole having a square or circular cross section. Each bracket 118 has two slots through which the bolts of two (2) spacing fasteners 116 pass.

As best shown in FIG. 9, the inner passage surface of the upper and lower plates 112 and 114 is shaped to accommodate a vertical pole having either a square or circular cross section. In particular, the inner passage surface of the upper and lower lower plates 112 and 114 has a square-shape to accommodate a vertical pole having a square cross section, wherein the corners of the square-shape are rounded. A rounded notch is positioned at the midpoint of each side of the square-shape, such that the four (4) notches create a circular shape to accommodate a vertical pole having a circular cross section.

Similar to the previous embodiment, each of the upper and lower plates 112 and 114 comprises first and second segments 138 and 140 which, when assembled, define a circular annulus. In this embodiment, the first and second segments 138 and 140 of the upper and lower plates abut and are devoid of mating formations.

Although the spacing fasteners are described as each comprising a bolt, nut and metal sleeve, those skilled in the art will appreciate that other types of spacing fasteners may be used. For example, the metal sleeves may be made of any suitable material such as rubber. As another example, the metal sleeves may be replaced with a single annular shaped piece of rubber having a plurality of holes aligned with the openings on the upper and lower plates. In this embodiment, the bolts are be inserted through the openings of the upper plate, rubber spacer, and lower plate.

Although the brackets are described as being L-shaped, those skilled in the art will appreciate that alternatives are available. For example, the brackets may each comprise an arm extending radially inward from the one of the upper and lower members. The innermost edge of each arm may comprise a material such as rubber to frictionally engage the support member. Also, although the brackets are described as being attached to the lower plate, those skilled in the art will appreciate that the brackets may be attached to the upper plate.

Although the upper and lower plates are described as being made of stainless steel, those skilled in the art will appreciate that the upper and lower plates may be made of any suitable material designed to withstand outdoor elements such as wind, rain and ice. Also, although the upper and lower plates are described as being circular annular, those skilled in the art will appreciate that alternatives are available. For example, the upper and lower plates may be square in plan but still define a passage suitable for circumscribing the support member.

Although the rotatable annular disc is described as being made of plastic, those skilled in the art will appreciate that the rotatable annular disc may be made of any suitable material designed to withstand outdoor elements such as wind, rain and ice.

Although embodiments of the banner support assembly have been shown and described above, those of skill in the art will appreciate that further variations and modifications may be made without departing from the scope thereof as defined by the appended claims.

What is claimed is:

1. A rotatable banner support assembly comprising:

upper and lower plates spaced by at least one spacing fastener, the upper and lower plates each defining a passage for circumscribing a support member, the upper and lower plates each comprising at least first and second segments, wherein the upper and lower plates are oriented such that seams between the first and second segments of the upper plate and seams between the first and second segments of the lower plate are misaligned;

a plurality of brackets mounted on one of the upper and lower plates to frictionally engage the support member, at least one of the brackets being radially adjustable; and a rotatable annular disc disposed between the upper and lower plates and circumscribing the at least one spacing fastener and the support member, the rotatable disc being configured to retain a banner arm;

wherein at least one of the plurality of brackets is positioned to overlay one of the seams on one of the upper and lower plates.

2. The rotatable banner support assembly of claim 1 wherein the upper and lower plates are co-axial.

3. The rotatable banner support assembly of claim 2 wherein the upper and lower plates are circular in plan.

4. The rotatable banner support assembly of claim 3 wherein the rotatable annular disc has an outer radius equal to an outer radius of the upper and lower plates.

5. The rotatable banner support assembly of claim 3 wherein the rotatable annular disc has an inner radius greater than an inner radius of upper and lower plates.

6. The rotatable banner support assembly of claim 5 wherein the difference between the inner radius of the rotatable annular disc and the inner radius of the upper and lower plates defines a spacing annular region on each of the upper and lower plates.

7. The rotatable banner support assembly of claim 6 wherein the at least one spacing fastener extends between openings defined in the spacing annular regions of the upper and lower plates.

8. The rotatable banner support assembly of claim 6 wherein the at least one spacing fastener comprises a plurality of circumferentially spaced, spacing fasteners extending between openings positioned about the spacing annular regions of the upper and lower plates.

9. The rotatable banner support assembly of claim 1 wherein a plurality of said brackets is radially adjustable.

10. The rotatable banner support assembly of claim 9 wherein each of said brackets is radially adjustable.

11. The rotatable banner support assembly of claim 10 wherein each of the brackets comprises a flange for frictionally engaging the support member.

12. The rotatable banner support assembly of claim 1 wherein the rotatable annular disc comprises at least first and second segments.

13. The rotatable banner support assembly of claim 12 wherein the first and second segments of the upper and lower plates and the first and second segments of the rotatable annular disc comprise mating formations.

14. The rotatable banner support assembly of claim 1 wherein an inner passage surface of each of the upper and lower plates is configured to accommodate a support member having one of a square cross section and a circular cross section.

15. A rotatable banner support assembly comprising:

upper and lower plates spaced by a plurality of spacing fasteners arranged in a ring and extending between the upper and lower plates, the upper and lower plates each defining a passage for circumscribing a support member, the upper and lower plates each comprising at least first and second segments, wherein the upper and lower plates are oriented such that seams between the first and second segments of the upper plate and seams between the first and second segments of the lower plate are misaligned;

a plurality of brackets mounted on one of the upper and lower plates configured to frictionally engage the support member; and a rotatable annular disc disposed between the upper and lower plates and circumscribing the spacing fasteners and the support member, the rotatable disc being configured to retain a banner arm and comprising at least first and second disc segments, said disc segments carrying mating formations;

wherein one or more of the brackets are positioned to overlay the seams on one of the upper and lower plates.

16. The rotatable banner support assembly of claim 15 wherein said first and second segments of said upper and lower plates comprise mating formations.

17. The rotatable banner support assembly of claim 15 wherein the first and second disc segments are secured to one another by at least one fastener.

18. The rotatable banner support assembly of claim 16 wherein the upper and lower plates are circular in plan.

19. The rotatable banner support assembly of claim 16 wherein at least one of the brackets is radially adjustable.

20. The rotatable banner support assembly of claim 19 wherein a plurality of said brackets is radially adjustable.

21. The rotatable banner support assembly of claim 20 wherein each of said brackets is radially adjustable.

22. The rotatable banner support assembly of claim 16 wherein an inner passage surface of each of the upper and lower plates is configured to accommodate a support member having one of a square cross section and a circular cross section.

23. A rotatable banner support assembly comprising:

upper and lower annular plates configured to surround an upright support member, each of said plates comprising a plurality of plate segments, the upper and lower plates being arranged such that seams between plate segments of the upper plate and seams between plate segments of the lower plate are misaligned;

a plurality of spacers extending between said upper and lower plates;

a rotatable annular disc disposed between the upper and lower plates and circumscribing the spacers and the support member, the rotatable disc being configured to retain a banner arm; and a plurality of brackets mounted on one of the upper and lower plates, the brackets configured to engage frictionally the support member, at least one of the brackets being radially adjustable, wherein at least one of the brackets is positioned to overlay one of the seams.

24. The rotatable banner support assembly of claim 23 wherein the upper and lower plates are circular in plan.

25. The rotatable banner support assembly of claim 24 wherein the rotatable annular disc has an outer radius equal to an outer radius of the upper and lower plates and wherein the rotatable annular disc has an inner radius greater than an inner radius of the upper and lower plates.

26. The rotatable banner support assembly of claim 23 wherein said spacers are equally spaced and arranged in a ring.

27. The rotatable banner support assembly of claim 23 wherein a plurality of said brackets is radially adjustable.

28. The rotatable banner support assembly of claim 27 wherein each of said brackets is radially adjustable.

29. The rotatable banner support assembly of claim 23 wherein a plurality of brackets is positioned to overlay seams.

* * * * *